US008273191B2

(12) United States Patent
Hirakawa et al.

(10) Patent No.: US 8,273,191 B2
(45) Date of Patent: Sep. 25, 2012

(54) HIGH-STRENGTH STAINLESS STEEL MATERIAL AND PRODUCTION PROCESS OF THE SAME

(75) Inventors: Naoki Hirakawa, Shunan (JP); Hiroshi Fujimoto, Shunan (JP); Satoshi Suzuki, Shunan (JP)

(73) Assignee: Nisshin Steel Co., Ltd., Tokyo (JP)

( * ) Notice: Subject to any disclaimer, the term of this patent is extended or adjusted under 35 U.S.C. 154(b) by 187 days.

(21) Appl. No.: 12/811,617

(22) PCT Filed: Feb. 2, 2009

(86) PCT No.: PCT/JP2009/051725

§ 371 (c)(1),
(2), (4) Date: Jul. 2, 2010

(87) PCT Pub. No.: WO2009/099035

PCT Pub. Date: Aug. 13, 2009

(65) Prior Publication Data

US 2010/0282372 A1 Nov. 11, 2010

(30) Foreign Application Priority Data

Feb. 7, 2008 (JP) ..... 2008-027712

(51) Int. Cl.
*C22C 38/40* (2006.01)
*C21D 6/02* (2006.01)

(52) U.S. Cl. ..... 148/326; 148/325; 148/607; 148/608

(58) Field of Classification Search ..... 148/607.608, 148/325, 326; 420/34
See application file for complete search history.

(56) References Cited

FOREIGN PATENT DOCUMENTS

| | | |
|---|---|---|
| JP | 2001-234290 | 8/2001 |
| JP | 2002-105601 | 4/2002 |
| JP | 2002-235156 | 8/2002 |
| JP | 2003-328083 | 11/2003 |
| JP | 2004-323960 | 11/2004 |
| JP | 2006-118018 | 5/2006 |

OTHER PUBLICATIONS

International Search Report for PCT/JP2009/051725, mailed May 12, 2009.
U.S. Appl. No. 12/936,794 to Kawano et al., which application is the National Stage of PCT/JP2009/058778, filed May 11, 2009.
International Preliminary Report on Patentability for PCT/JP2009/051725, mailed Sep. 16, 2010.

*Primary Examiner* — Deborah Yee
(74) *Attorney, Agent, or Firm* — Greenblum & Bernstein, P.L.C.

(57) ABSTRACT

Provided is a high-strength stainless steel material having less deterioration in mechanical strength and improved workability, particularly bending workability compared with conventional steel materials. The high-strength stainless steel material of the present invention has a specific composition, has a metal microstructure composed of two phases, that is a ferrite phase and a martensite phase, has a γmax of from 50 to 85, the $\gamma_{max}$ being represented by the following equation (1):

$$\gamma_{max}=420W_c+470W_N+23W_{Ni}+7W_{Mn}-11.5W_{Cr}-11.5W_{Si}+189 \quad (1)$$

wherein, $W_c$, $W_N$, $W_{Ni}$, $W_{Mn}$, $W_{Cr}$, and $W_{Si}$; represent contents (unit: mass %) of C, N, Ni, Mn, Cr, and Si relative to the total mass of the stainless steel material, respectively; and has a difference of 300 HV or less in hardness between the ferrite phase and the martensite phase.

8 Claims, 3 Drawing Sheets

INVENTION STEEL No. 1

COMPARATIVE STEEL

HIGH-STRENGTH STAINLESS STEEL MATERIAL AND PRODUCTION PROCESS OF THE SAME

TECHNICAL FIELD

The present invention relates to a high-strength stainless steel material and a production process thereof.

BACKGROUND ART

Stainless steel materials having a metal microstructure composed of a double phase, that is, a ferrite phase and a martensite phase and therefore having improved workability have conventionally been put on the market as high-strength stainless steel materials. Such stainless steel materials are produced by heat treatment for obtaining a microstructure having a double phase of ferrite and martensite. Since these stainless steel materials have two phases, they have both high mechanical strength derived from the hard martensite phase and good workability derived from the soft ferrite phase. It is therefore possible to produce a stainless steel material having, to some extent, excellent workability by the formation of a double-phase metal microstructure, but impossible to improve the workability further without limitation. It is therefore difficult to use a conventional stainless steel as a material of products required to have higher workability.

With a view to providing a high-strength stainless steel sheet excellent in ductility and well balanced between strength and ductility and therefore suited for applications to be subjected to bending work, Patent Document 1 discloses a production process of a high-strength stainless steel sheet comprising successively carrying out a step of heating a stainless steel sheet at a temperature in a two-phase region and then cooling it at a cooling rate of 5° C./s or greater, a step of cold rolling the resulting sheet at a predetermined rolling reduction, and a step of heat treating the sheet at a predetermined temperature.

With a view to improving workability, particularly, bending workability, Patent Document 2 proposes a method of moderately decarburizing the surface portion of a stainless steel sheet having a two-phase microstructure. This method can realize high bending workability because a soft ferrite phase can be formed much in the surface portion of a stainless steel sheet and ductility on the surface portion can be improved.

Patent Document 1: Japanese Patent Application Laid-Open No. 2004-323960

Patent Document 2: Japanese Patent Application Laid-Open No. 2001-234290

DISCLOSURE OF THE INVENTION

Problem to be Solved by the Invention

If the demand for workability will be severer in future, however, conventional stainless steel materials should be improved further. As an improving method, a method of reviewing the chemical composition of conventional stainless steel materials and reducing a proportion of a martensite phase in a metal microstructure can be considered. This method improves the workability of the stainless steel material but reduces the mechanical strength (hardness) of the whole steel material.

According to the method described in Patent Document 2, decarburization requires heat treatment at a temperature as high as from 1100 to 1200° C. Further, there is a possibility of the mechanical strength of the whole steel material deteriorating, depending on the proportion of the soft ferrite phase.

With the foregoing in view, the present invention has been made. An object of the invention is to provide a high-strength stainless steel material capable of having improved workability, particularly, bending workability compared with the conventional ones while suppressing deterioration in mechanical strength.

Means for Solving the Problem

The present inventors have proceeded with an intensive investigation with a view to achieving the above-described object. As a result, it has been found that decreasing a difference in hardness between a soft ferrite phase and a hard martensite phase compared with that of conventional stainless steel materials is effective. When the difference is decreased, the object of the present invention can be achieved because a stress upon processing of a stainless steel material is dispersed and the resulting steel material can have improved ductility. The present inventors have also found that a production process of a stainless steel material including a step of carrying out an aging treatment at a predetermined stage is effective for obtaining such a stainless steel material. Based on these findings, the present inventors have completed the present invention. The present inventors have also found that stress dispersion upon processing of a stainless steel material and improvement in ductility of steel are achieved by decreasing a difference in hardness between the two phases, which further brings about a beneficial effect for improving not only bending workability but also a hole expanding property.

A high-strength stainless steel material in one aspect of the present invention has a composition comprising, as essential components thereof, greater than 0.00 mass % but not greater than 0.15 mass % of C, greater than 0.0 mass % but not greater than 2.0 mass % of Si, greater than 0.0 mass % but not greater than 4.0 mass % of Mn, greater than 0.00 mass % but not greater than 0.04 mass % of P, greater than 0.00 mass % but not greater than 0.03 mass % of S, greater than 0.0 mass % but not greater than 4.0 mass % of Ni, from 10.0 to 20.0 mass % of Cr, and greater than 0.00 mass % but not greater than 0.12 mass % of N with a balance of Fe and inevitable impurities; has a metal microstructure composed of two phases, one of the phases being a ferrite phase and the other of the phases being a martensite phase; has a $\gamma_{max}$ of from 50 to 85, the $\gamma_{max}$ being represented by the following equation (1):

$$\gamma max=420W_c+470W_N+23W_{Ni}+7W_{Mn}-11.5W_{Cr}-11.5W_{Si}+189 \quad (1)$$

(in the equation (1), $W_c$, $W_N$, $W_{Ni}$, $W_{Mn}$, $W_{Cr}$ and $W_{Si}$ represent contents (unit: mass %) of C, N, Ni, Mn, Cr, and Si relative to the total mass of the stainless steel material, respectively; and has a difference of 300 HV or less in hardness between the ferrite phase and the martensite phase.

A high-strength stainless steel material according to another aspect of the present invention has a composition comprising, as essential components, greater than 0.00 mass % but not greater than 0.15 mass % of C, greater than 0.0 mass % but not greater than 2.0 mass % of Si, greater than 0.0 mass % but not greater than 4.0 mass % of Mn, greater than 0.00 mass % but not greater than 0.04 mass % of P, greater than 0.00 mass % but not greater than 0.03 mass % of S, greater than 0.0 mass % but not greater than 4.0 mass %, Cr: from 10.0 to 20.0 mass % of Ni, and greater than 0.00 mass % but not greater than 0.12 mass % of N with balance of Fe and inevitable impurities; has a metal microstructure composed of two phases, one of the phases being a ferrite phase and the other of the phases being a martensite phase; has a $\gamma_{max}$ of from 50 to 85, the $\gamma_{max}$ being represented by the equation (1); and has yield elongation: Since a stainless steel material has improved ductility by having yield elongation so that it can also achieve the object of the present invention.

A production process of a high-strength stainless steel material according to the present invention provides a step of subjecting, to a dual-phase formation treatment, a steel piece having a composition comprising, as essential components, greater than 0.00 mass % but not greater than 0.15 mass % of C, greater than 0.0 mass % but not greater than 2.0 mass % of Si, greater than 0.0 mass % but not greater than 4.0 mass % of Mn, greater than 0.00 mass % but not greater than 0.04 mass % of P, greater than 0.00 mass % but not greater than 0.03 mass % of S, greater than 0.0 mass % but not greater than 4.0 mass % of Ni, from 10.0 to 20.0 mass % of Cr, and greater than 0.00 mass % but not greater than 0.12 mass % of N with balance of Fe and inevitable impurities; and having a $\gamma_{max}$ of from 50 to 85, the $\gamma_{max}$ being represented by the above equation (1); and a step of subjecting the steel piece obtained by the above dual-phase formation treatment to an aging treatment. The high-strength stainless steel of the present invention described above can be obtained by this production process.

The stainless steel material or steel piece may further contain greater than 0.0 mass % but not greater than 3.0 mass % of Cu and in this case, it may have a $\gamma_{max}$ of from 50 to 85, the $\gamma_{max}$ being represented by, instead of the equation (1), the following equation (2):

$$\gamma_{max}=420W_c+470W_N+23W_{Ni}m+9W_{Cu}+7W_{Mn}-11.5W_{Cr}-11.5W_{Si}+189 \quad (2)$$

here in the equation (2), $W_c$, $W_N$, $W_{Ni}$, $W_{Cu}$, $W_{Mn}$, $W_{Cr}$, and $W_{Si}$ represent contents (unit: mass %) of C, N, Ni, Cu, Mn, Cr, and Si relative to the total mass of the stainless steel material or steel piece, respectively.

Effect of the Invention

The present invention makes it possible to provide a high-strength stainless steel material having less reduction in mechanical strength and at the same time, having improved workability, particularly, improved bending workability compared with conventional stainless steel materials.

BEST MODE FOR CARRYING OUT THE INVENTION

Figure 1:
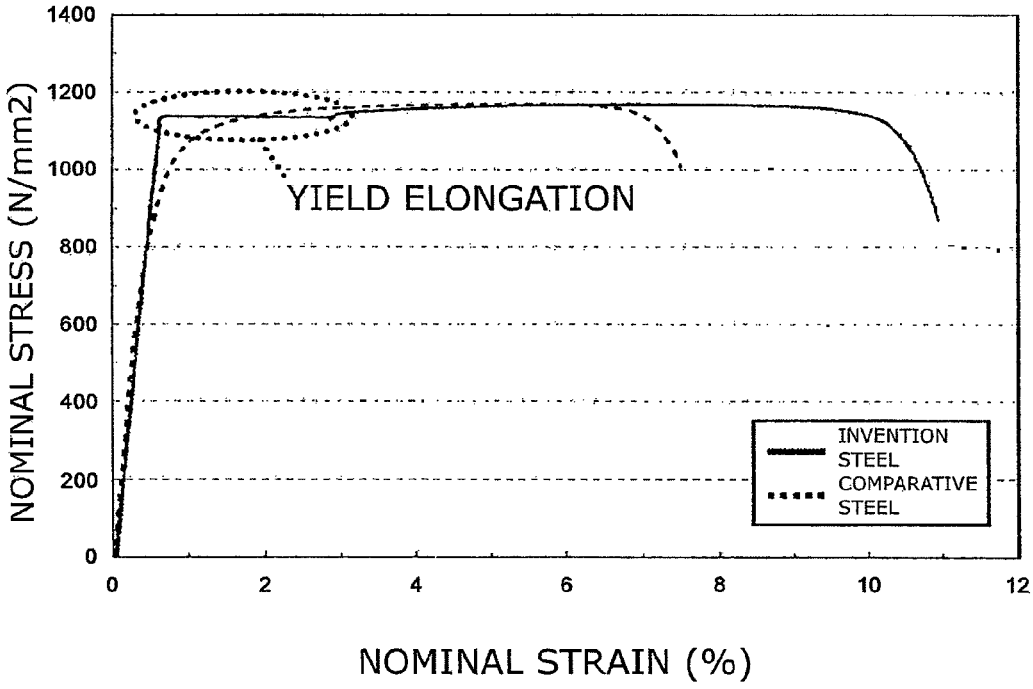
FIG. 1 is a plot diagram showing a nominal stress-nominal strain curve obtained in a tensile test of a stainless steel test piece.

The best mode for carrying out the present invention (which will hereinafter be called "present embodiment" simply) will next be described in detail referring to the drawings if necessary.

First, a high-strength stainless steel material (which may hereinafter be called "stainless steel material" or "steel material" simply) is described. The high-strength stainless steel material according to the present embodiment has a composition comprising, as essential components, C: greater than 0.00 mass % but not greater than 0.15 mass %, Si: greater than 0.0 mass % but not greater than 2.0 mass %, Mn: greater than 0.0 mass % but not greater than 4.0 mass %, P: greater than 0.00 mass % but not greater than 0.04 mass %, S: greater than 0.00 mass % but not greater than 0.03 mass %, Ni: greater than 0.0 mass % but not greater than 4.0 mass %, Cr: from 10.0 to 20.0 mass %, and N: greater than 0.00 mass % but not greater than 0.12 mass % with a balance of Fe and inevitable impurities; has a metal microstructure composed of two phases, that is, a ferrite phase and a martensite phase; and has a $\gamma_{ma}$, of from 50 to 85, the $\gamma_{max}$ being represented by the following equation (1).

$$\gamma_{max}=420W_c+470W_N+23W_{Ni}+7W_{Mn}-11.5W_{Cr}-11.5W_{Si}+189 \quad (1)$$

Here in the equation (1), $W_c$, $W_N$, $W_{Ni}$, $W_{Mn}$, $W_{Cr}$, and $W_{Si}$ represent contents (unit: mass %) of C, N, Ni, Mn, Cr, and Si relative to the total mass of the stainless steel material, respectively.

The stainless steel material of the present embodiment contains from 10.0 to 20.0 mass % of Cr (chromium) in order to keep corrosion resistance and strength as a stainless steel. Too low contents of Cr make it difficult to form an oxide film, resulting in failure to achieve excellent corrosion resistance. The content of Cr is 10.0 mass % or greater from this standpoint. When the content of Cr is too high, on the other hand, a large amount of an austenite-forming element such as Ni and Mn is required in order to form a martensite phase and thereby achieve high strength. At the same time, a stainless steel material having a too high content of Cr has reduced toughness. From this viewpoint, the content of Cr is 20.0 mass % or less.

The stainless steel material of the present embodiment contains C (carbon) in an amount exceeding 0.00 mass % but not greater than 0.15 mass %. Since C is a strong austenite-forming element, it raises the proportion of the martensite phase in the metal microstructure. In addition, C exhibits a solid solution hardening effect so that it is effective for heightening the strength of both the martensite phase and the ferrite phase. From the standpoint of exhibiting such an effect more effectively, the content of C is preferably 0.01 mass % or greater. From the standpoint of sufficiently heightening corrosion resistance of the stainless steel material of the present embodiment, on the other hand, the content of C is 0.15 mass % or less. In a production process of the stainless steel material of the present embodiment which will be described later, when a steel piece is subjected to a dual phase formation treatment, chromium carbide forms a solid solution by heating. When the content of C exceeds 0.15 mass %, however, the chromium carbide is likely to be reprecipitated in a grain boundary of the ferrite phase or austenite phase (martensite phase after cooling) upon cooling after the dual phase formation treatment, which however depends on the composition ratio of C to another element such as Cr, Ni, or Mn. As a result, a Cr depletion layer is generated (sensitization occurs) in the vicinity of the grain boundary, leading to deterioration in corrosion resistance.

The stainless steel material of the present embodiment contains Si (silicon) in an amount exceeding 0.0 mass % but not greater than 2.0 mass %. Si is added for the purpose of deacidification. In addition, Si hardens the martensite phase and at the same time, hardens the austenite phase, forming a solid solution in the austenite phase. Further, Si causes strain aging at the time of an aging treatment and thereby accelerates an age hardening capacity. From the standpoint of effectively producing these effects, the content of Si exceeds 0.0 mass %. On the other hand, the content of Si is not greater than 2.0 mass % from the standpoint of suppressing high temperature cracks of the stainless steel material and at the same time, forms a preferable martensite phase.

The stainless steel material of the present embodiment contains Mn (manganese) in an amount exceeding 0.0 mass % but not greater than 4.0 mass %. This steel material also contains Ni (nickel) in an amount exceeding 0.0 mass % but not greater than 4.0 mass %. This steel material may further contain Cu (copper) in an amount of 3.0 mass % or less as an arbitrary component. These Mn, Ni, and Cu function as austenite forming elements. The stainless steel material of the present embodiment, when containing these elements, can have a metal microstructure composed of two phases, that is, a ferrite phase and a martensite phase at high temperatures. With an increase in the contents of Mn, Ni, and Cu, the proportion of the martensite phase increases after cooling so that the steel material containing these elements in greater amounts has higher strength. To secure their effect more effectively, the contents of Mn, Ni, and Cu are preferably a certain amount or greater depending on the contents of Cr and C. More specifically, they are each added in an amount of preferably 0.1 mass % or greater. When the proportion of the martensite phase in the metal microstructure becomes too large, the resulting steel material is likely to have reduced ductility though having sufficient strength. From the standpoint of suppressing such a reduction in ductility, the contents of Mn and Ni are each preferably 4.0 mass % or less. The content of Mn is more preferably 2.0 mass % or less and the content of Cu, if any, is preferably 3.0 mass % or less.

In the stainless steel material of the present embodiment, the content of P (phosphorus) is limited to 0.04 mass % or less and the content of S (sulfur) is limited to 0.03 mass % or less. From the standpoint of preventing heightening of brittleness of the steel material, the content of P is 0.04 mass % or less and that of S is 0.03 mass % or less.

The stainless steel material of the present embodiment contains N (nitrogen) in an amount exceeding 0.00 mass % but not greater than 0.12 mass %. Since N is a strong austenite-forming element, it increases the proportion of the martensite phase in the metal microstructure. In addition, N is effective for heightening the strength of the martensite phase because it produces a solid solution hardening effect. On the other hand, it is difficult to incorporate a large amount of N in the stainless steel material of the present embodiment due to the solubility of N and even if a large amount of N can be incorporated, it may be a cause for increasing defects in the surface of the steel material. From such viewpoints, the content of N is 0.12 mass % or less.

The stainless steel material of the present embodiment may contain Mo (molybdenum) as an arbitrary component for solid solution hardening and thereby having improved high-temperature strength. In addition, the stainless steel material of the present embodiment may contain, as an arbitrary component, at least one metal element selected from the group consisting of V (vanadium), Nb (niobium), and Ti (titanium) for precipitation strengthening, thereby having improved high-temperature strength and at the same time, having heightened weldability and toughness.

The stainless steel material of the present embodiment has a $\gamma_{max}$, which is represented by the equation (1), of from 50 to 85 from the standpoint of securing high strength and good workability. The $\gamma_{max}$ is 50 or greater in order to obtain a steel material having high strength. The $\gamma_{max}$ is, on the other hand, 85 or less in order to prevent worsening of workability which will otherwise occur due to an excessive increase in the proportion of the martensite phase in the metal microstructure. This $\gamma_{max}$ is one of factors influencing on the proportions of the ferrite phase and martensite phase. When the stainless steel contains at least one or more of Cu, Mo, V, Nb, and Ti as an arbitrary component, the $\gamma_{max}$ can be represented by the equation (3) instead of the equation (1) and it ranges from 50 to 85 from similar standpoints to those described above.

$$\gamma_{max}=420W_c+470W_N+23W_{Ni}+9W_{Cu}+7W_{Mn}-11.5W_{Cr}-11.5W_{Si}-12W_{Mo}-23W_V-47W_{Nb}-49W_{Ti}+189 \quad (3)$$

Here in the equation (3), $W_c$, $W_N$, $W_{Ni}$, $W_{Cu}$, $W_{Mn}$, $W_{Cr}$, $W_{Si}$, $W_{Mo}$, $W_V$, $W_{Nb}$, and $W_{Ti}$ represent contents (unit: mass %) of C, N, Ni, Cu, Mn, Cr, Si, Mo, V, Nb, and Ti relative to the total mass of the stainless steel material, respectively. In the above equation (3), the content of the arbitrary component ($W_{Cu}$, $W_{Mo}$, $W_V$, $W_{Nb}$, or $W_{Ti}$) not contained in the stainless steel material is 0. When only Cu is contained as an arbitrary component in the stainless steel material, the above equation (3) has the same meaning as the equation (2).

The stainless steel material of the present embodiment has a metal microstructure composed of two phases, that is, a ferrite phase and a martensite phase. This steel material has good workability derived from the soft ferrite phase, while it has high strength derived from the hard martensite phase. Such a metal microstructure is available by a dual-phase formation treatment which will be described later.

In the stainless steel material of the present embodiment, a difference in hardness between the ferrite phase and the martensite phase is 300 HV or less. The term "hardness" of each phase as used herein means hardness determined by confirming the position of each phase in the surface of the stainless steel material by using a scanning electron microscope (SEM) and measuring the hardness of each phase by using the nanoindentation hardness measurement method. The measurement conditions of the nanoindentation hardness measurement method are as follows:

Tip: XP

Measurement mode: CSM (continuous stiffness measurement)

Excited oscillation frequency: 45 Hz

Excited oscillation amplitude: 2 nm

Strain rate: 0.05/s

Indentation depth: 200 nm

The number of samples: 10

Distance between measured points: 10 μm

Measurement environment: room temperature 23° C. (air conditioned)

Standard sample: molten silica

By adjusting a difference in hardness between two phases to 300 HV or less, the stainless steel material of the present embodiment becomes superior in bending workability and hole expanding property to the conventional ones. From the standpoint of improving the bending workability and hole expanding property further, the difference in hardness between two phases is more preferably 280 HV or less, still more preferably 270 HV or less. It is needless to say that the hardness of the martensite phase becomes higher than that of the ferrite phase. Although no particular limitation is imposed on the lower limit of the difference in hardness between two phases, it may be 250 HV from the standpoint of ease of production.

In the stainless steel material of the present embodiment, the hardness of the ferrite phase is not particularly limited. It is however preferably from 330 to 370 HV, more preferably from 350 to 370 HV from the standpoint of improving the balance between mechanical strength (hardness) and workability. The hardness of the martensite phase is also not particularly limited. From the standpoint of improving the balance between mechanical strength (hardness) and workability, however, the hardness is preferably from 580 to 620 HV, more preferably from 580 to 600 HV.

For adjusting the hardness of each of the ferrite phase and the martensite phase, it is only necessary to change the composition ratio of the elements. Alternatively, the hardness can be adjusted by carrying out an aging treatment while changing its condition (maximum temperature, soaking time, tempering parameter, or the like), which will be described later.

The stainless steel material of the present embodiment may have yield elongation instead of or in addition to the difference in hardness between two phases. By having yield expansion, the stainless steel material of the present embodiment can have bending workability and hole expanding property superior to those of conventional materials and has less reduction in mechanical strength (hardness). The term "have (or having) yield elongation" as used herein means that when a test piece of a stainless steel sheet is subjected to a tensile test, it shows an upper yield point and also yield elongation (Lueders band). The test piece is a JIS13B test piece specified in JIS Z-2201 and collected from a stainless steel sheet in a T direction thereof. The tensile test is performed at a pulling rate of 1 mm/min by using a 50 kN tensile tester. The yield elongation is preferably 1% or greater from the standpoint of obtaining a steel material having better bending workability and hole expanding property.

The stainless steel material having the above composition only needs an aging treatment at a predetermined temperature or less, preferably less than 600° C. in order to have yield elongation.

The stainless steel material of the present embodiment may be a stainless steel sheet. The stainless steel sheet may be formed into shapes of various parts by press molding or punching.

Various members may be obtained from the stainless steel material of the present embodiment. Examples of such members include flat spring, punched spring, and mechanical cover. These members are produced in a similar manner to the conventional method except for the use of the stainless steel material of the present embodiment. These members may each be composed only of the stainless steel material of the present embodiment or composed partly of the stainless steel material of the present embodiment.

The above-described stainless steel material of the present embodiment has a metal microstructure composed of two phases, that is, a ferrite phase and a martensite phase so that it has high strength and exhibits excellent workability. In addition, the high-strength stainless steel material of the present embodiment is excellent in workability, particularly bending workability and hole expanding property. The bending workability and hole expanding property become excellent by a reduction in the difference in strength between these two phases and improvement in ductility. It is considered that when the difference in strength between two phases becomes 300 HV or less in terms of a difference in hardness, which is smaller than that of the conventional steel materials, a deforming stress cannot easily concentrate on the soft ferrite phase during processing such as bending. As a result, it is presumed that stress dispersion occurs throughout the stainless steel and the bending workability and hole expanding property become superior to those of the conventional stainless steel. In the stainless steel material having yield elongation, pinning of dislocations occurs in the ferrite phase due to C or N which has formed a solid solution. This leads to appearance of an upper yield point and yield elongation (Lueders band) and as a result, the resulting stainless steel material is presumed to have improved ductility and have bending workability superior to that of the conventional steel material. Further, when the stainless steel material has yield elongation, a reduction in mechanical strength (hardness) is suppressed further and at the same time, deterioration in corrosion resistance can be prevented, compared with a stainless steel material having a similar composition and having the same level of ductility.

The production process of a high-strength stainless steel material according to the present embodiment will hereinafter be described. The production process of a high-strength stainless steel material according to the present embodiment provides a step of subjecting, to a dual-phase formation treatment (which step will hereinafter be called "dual-phase formation treatment step"), a steel piece having a composition comprising, as essential components, C: greater than 0.00 mass % but not greater than 0.15 mass %, Si: greater than 0.0 mass % but not greater than 2.0 mass %, Mn: greater than 0.0 mass % but not greater than 4.0 mass %, P: greater than 0.00 mass % but not greater than 0.04 mass %, S: greater than 0.00 mass % but not greater than 0.03 mass %, Ni: greater than 0.0 mass % but not greater than 4.0 mass %, Cr: from 10.0 to 20.0 mass %, and N: greater than 0.00 mass % but not greater than 0.12 mass % with a balance of Fe and inevitable impurities; and having a $\gamma_{max}$ of from 50 to 85, the $\gamma_{max}$ being represented by the above equation (1) (which steel piece will hereinafter be called "first steel piece"); and a step of subjecting the steel piece obtained by the above dual-phase formation treatment (which steel piece will hereinafter be called "second steel piece") to an aging treatment (which step will hereinafter be called "aging treatment step").

First, the first steel piece to be used for the dual-phase formation treatment step is prepared. No particular limitation is imposed on the first steel piece insofar as it has the above-described specific composition and has the $\gamma_{max}$, which is represented by the above equation (1), of from 50 to 85. For example, the first steel piece may be a cold rolled sheet (having, for example, a thickness of from 0.3 to 2 mm) available by predetermined cold rolling. The production process of a stainless steel material according to the present embodiment does not have a step of cold rolling between the dual-phase formation treatment step and the aging treatment step so that the first steel piece is preferably that already subjected to cold rolling. There is no particular limitation imposed on the shape of the first steel piece and it may be, for example, in sheet form.

The first steel piece may contain the above-described elements, that is, Cu, Mo, V, Nb, and Ti as arbitrary components. The contents of these elements in the first steel piece and $\gamma_{max}$ of the resulting first steel piece may be similar to those of the above stainless steel material.

Next, in the dual-phase formation treatment step, the first steel piece is subjected to a dual-phase formation treatment to generate a metal microstructure having two phases, that is, an austenite phase, which will be transformed into a martensite phase by cooling to be performed later and a ferrite phase. Conditions (temperature, time) of the dual phase formation treatment are not particular limited insofar as they can generate a metal microstructure having both the austenite phase and ferrite phase. They may be changed, depending on the composition ratio of the elements. Accordingly, the first steel piece may be subjected to the dual-phase formation treatment, for example, at a temperature of from 800 to 1200° C. for a soaking time of from 1 to 10 minutes.

Next, in the aging treatment step, the second steel piece obtained by the dual-phase formation treatment is subjected to a predetermined aging treatment. It is presumed that by this treatment, hardness increases in the ferrite phase because C and N, which have formed a solid solution in the second steel piece, pin dislocations, while in the martensite phase, the hardness decreases due to tempering. As a result, a difference in hardness between these two phases becomes 300 HV or less. The stainless steel material available as a final product has yield elongation due to the pinning of dislocations caused by the aging treatment. Further, since the second steel material is not subjected to cold working between the dual-phase formation treatment step and the aging treatment step, the resulting stainless steel has further improved workability compared with steel materials subjected to cold working such as cold rolling after the dual-phase formation treatment. When the second steel piece obtained by the dual phase formation treatment is cooled for providing it to the aging treatment step, the cooling rate is preferably from 5 to 1000° C./sec in order to transform the austenite phase to the martensite phase.

From the standpoint of suppressing a reduction in mechanical strength (hardness) of the stainless steel material, the maximum temperature in the aging treatment step is preferably less than 600° C. From the standpoint of achieving the object of the present invention without failure, the maximum temperature is more preferably 300° C. or greater but less than 600° C., still more preferably from 300 to 500° C. Adjustment of the maximum temperature to less than 600° C. enables to prevent deterioration of corrosion resistance and mechanical strength (hardness) which will otherwise occur due to the precipitation of C, which has formed a solid solution, as chromium carbide.

When the soaking time in the aging treatment becomes longer than a predetermined time, the bending workability tends to show a further improvement, but marked deterioration in strength or corrosion resistance tends to occur due to precipitation of a carbide. It is therefore preferred to adjust the soaking time, at the maximum temperature, to 0 second because the bending workability can be improved while suppressing precipitation of a carbide and maintaining the mechanical strength or corrosion resistance at a high level.

The aging treatment is preferably performed at the maximum temperature falling within a range of 300° C. or greater but less than 600° C. under the conditions permitting a tempering parameter (Larson-Miller parameter) $P_{LM}$ represented by the below equation (4) to fall within a range of from 12000 to 15000. This tempering parameter is explained in *Heat treatment,* 42(3), 163.

[Equation 1]

$$P_{LM}=T_n(\log t_n+20) \quad (4)$$

wherein:

[Equation 2]

$$T_n=T_{n-1}+\alpha\Delta T$$

$$t_n=10^{((T_{n-1}/T_n)\cdot(\log t_{n-1}+20)-(20)}+\Delta t$$

$$t_1=\Delta t$$

a unit of the temperature $T_n$, $T_{n-1}$, or $\Delta T$ is K, a unit of the time $t_n$, $t_{n-1}$, or $t_1$ is hour, and a represents a temperature increasing or decreasing rate (unit: K/hour) at temperature $T_{n-1}$. When the tempering parameter exceeds 15000, a marked reduction in mechanical strength (hardness) of the steel material which is presumed to occur due to precipitation of chromium carbide and decomposition of the martensite tends to occur. When the tempering parameter is below 12000, on the other hand, an increase in the hardness of the ferrite phase due to the formation of a Cottrell atmosphere and a reduction in the hardness of the martensite phase due to the tempering become both small, making it difficult to decrease a difference in hardness between two phases. As a result, there tends to be less effect on the improvement of bending workability and hole expanding property.

The steel piece obtained by the aging treatment step may be used either as the stainless steel material of the present embodiment as is or after known treatment such as leveling process or pickling if necessary for the purpose of correcting the shape of it.

When the above-described production process of a high-strength stainless steel material according to the present embodiment is employed, a high-strength stainless steel material having high strength and at the same time having excellent workability can be obtained because a metal microstructure composed of two phases, that is, a ferrite phase and a martensite phase is formed by the specific dual-phase formation treatment of the first steel piece having the above-described composition. Further, the high-strength stainless steel material thus obtained is excellent in workability, particularly bending workability and hole expanding property. The excellent bending workability and hole expanding property can be achieved by a reduction in difference in the strength between the two phases and improvement in ductility. By subjecting the second steel material to the aging treatment, C which has formed a solid solution pins the dislocation in the ferrite phase, raising the strength of the ferrite phase, while tempering occurs in the martensite phase, causing some reduction in strength. Thus, the difference in hardness between the two phases can be decreased to 300 HV or less, smaller than the conventional one so that a deforming stress does not easily concentrate in the soft ferrite phase during processing such as bending. As a result, stress dispersion occurs throughout the resulting stainless steel material and the resulting steel material is presumed to be superior in bending workability and hole expanding property to conventional materials. This aging treatment is given to the second steel piece obtained by carrying out the dual-phase formation treatment but carrying out cold working treatment thereafter so that the finally available stainless steel material has the same composition as the second steel piece, and is superior in bending workability and hole expanding property to steel materials subjected to cold working treatment such as cold rolling after the dual-phase formation treatment. It is considered that pinning of dislocations occurs in the ferrite phase due to C or N which has formed a solid solution by the aging treatment and the stainless steel material therefore has yield elongation. As a result, the stainless steel is presumed to have improved ductility and become superior in bending workability and hole expanding property to conventional stainless steel materials.

The present embodiments have been described above, but the present invention is not limited to or by them. Various changes or modifications may be effected therein without departing from the scope of the invention.

EXAMPLES

The present invention will hereinafter be described more specifically by examples, but the present invention is not limited to or by these examples.

<Preparation of Stainless Steel Sheet>

In a vacuum melting furnace, 30 kg of 12 kinds of steels (Steels Nos. 1 to 12) having the compositions as shown in Table 1 were melted and cast into ingots, respectively. The ingots thus obtained were cut into slabs. The slabs were heated to 1200° C., followed by extraction. Hot rolling was effected at a finishing temperature of 920° C. to obtain hot rolled steel strips having a sheet thickness of 4.5 mm. Then, the hot rolled steel strips were subjected to a hot-rolled sheet tempering treatment by furnace cooling at 800° C. for a soaking time of 6 hours. After pickling, cold rolling was conducted to obtain first cold rolled sheets having a sheet thickness of 1.8 mm. The first cold rolled sheets thus obtained were subjected to a tempering treatment at 770° C. for a soaking time of one minute. After pickling, cold rolling was conducted to obtain second cold rolled sheets each having a sheet thickness of 0.8 mm.

TABLE 1

| Steel | Composition (mass %) | | | | | | | | | | |
|---|---|---|---|---|---|---|---|---|---|---|---|
| No. | C | Si | Mn | P | S | Ni | Cr | N | Cu | Fe | $\gamma_{max}$ |
| 1 | 0.059 | 0.53 | 0.29 | 0.031 | 0.001 | 2.01 | 16.3 | 0.009 | — | Balance | 72 |
| 2 | 0.031 | 0.55 | 0.31 | 0.021 | 0.003 | 1.55 | 16.2 | 0.011 | — | Balance | 52 |
| 3 | 0.055 | 0.042 | 0.28 | 0.022 | 0.005 | 1.09 | 16.3 | 0.009 | — | Balance | 55 |
| 4 | 0.058 | 0.44 | 0.23 | 0.021 | 0.003 | 0.12 | 13.1 | 0.012 | — | Balance | 68 |
| 5 | 0.042 | 0.051 | 0.31 | 0.022 | 0.002 | 0.21 | 12.1 | 0.008 | — | Balance | 78 |
| 6 | 0.052 | 0.55 | 0.28 | 0.032 | 0.003 | 1.71 | 14.5 | 0.009 | — | Balance | 83 |
| 7 | 0.071 | 0.51 | 0.26 | 0.031 | 0.003 | 2.31 | 18.1 | 0.012 | — | Balance | 65 |
| 8 | 0.029 | 0.48 | 0.31 | 0.029 | 0.001 | 2.41 | 16.5 | 0.027 | 0.5 | Balance | 81 |
| 9 | 0.057 | 0.56 | 0.30 | 0.031 | 0.002 | 2.02 | 16.3 | 0.011 | 1.1 | Balance | 83 |
| 10 | 0.048 | 0.48 | 0.27 | 0.032 | 0.004 | 1.34 | 15.3 | 0.0012 | 1.7 | Balance | 76 |
| 11 | 0.062 | 1.6 | 0.29 | 0.031 | 0.001 | 2.01 | 16.3 | 0.011 | — | Balance | 62 |
| 12 | 0.059 | 1.1 | 0.31 | 0.033 | 0.003 | 1.98 | 15.8 | 0.011 | 0.2 | Balance | 74 |

Then, the second cold rolled sheets were subjected to a dual-phase formation treatment (dual-phase formation treatment step) under the conditions of 1050° C. and a soaking time of one minute. After the dual-phase formation treatment, the resulting steel pieces were subjected to an aging treatment (aging treatment step) in the atmosphere under the following conditions: the maximum temperature of 480° C., soaking time of 0 second, and a tempering parameter of 13500 to obtain high-strength stainless steel sheets. The steel sheets after finishing the aging treatment were designated as invention steels. In addition, steel pieces, which had been obtained by subjecting the No. 1 steel to a similar dual-phase formation treatment to that employed above, were subjected to an aging treatment in the atmosphere under the following conditions: the maximum temperature of 600° C., 625° C., and 650° C., a soaking time of 0 second, and a tempering parameter of 15710, 16300, and 16900, respectively to obtain invention steels (Steel Nos. 13, 14, and 15), respectively.

On the other hand, stainless steel sheets were obtained respectively by using 12 kinds of steels having the compositions as shown in Table 1 and subjecting them to a similar dual-phase formation treatment to that described above. The resulting steel sheets not subjected to the aging treatment were designated as comparative steels.

<Measurement of Hardness>

The positions of the ferrite phase and the martensite phase in the surface of each of the steel sheets thus obtained were confirmed using SEM. Then, the hardness of each phase was measured according to the above-described nanoindentation hardness measuring method. In addition, Vickers hardness of the entire steel sheet was measured in accordance with the standard JIS Z-2240 at a test load of 30 kg. The results are shown in Tables 2 and 3.

<Tensile Test>

A JIS13B test piece as specified in JIS Z-2201 was collected from each of the resulting steel sheets in a T direction thereof and a tensile test was made on it at a pulling rate of 1 mm/min by using a 50-kN tensile tester. FIG. 1 shows a nominal stress-nominal strain curve drawn based on the results of the tensile test on the invention steel No. 1 and comparative steel No. 1. The results of total elongation and evaluation results of yield elongation are shown in Tables 2 and 3. More specifically, the steel sheet exhibiting yield elongation is evaluated as "A" and that exhibiting no yield elongation is evaluated as "B". It has been understood from these results that the invention steel having a difference of 300 HV or less in hardness between the ferrite phase and the martensite phase exhibits yield elongation and as a result, the total elongation is several % greater than that of the comparative steel.

TABLE 2

| | Invention steel | | | | | | | |
|---|---|---|---|---|---|---|---|---|
| | Hardness (HV) | | | | | | | Maximum |
| Steel No. | Entire steel sheet | Martensite phase | Ferrite phase | Difference | Total elongation (%) | Yield elongation | Bending test result | hole expanding ratio (%) |
| 1 | 376 | 610 | 350 | 260 | 10.5 | A | A | 60 |
| 2 | 287 | 572 | 325 | 247 | 14.7 | A | A | 99 |
| 3 | 295 | 596 | 340 | 256 | 14.1 | A | A | 93 |
| 4 | 311 | 598 | 345 | 253 | 13.8 | A | A | 68 |
| 5 | 320 | 583 | 318 | 265 | 13.4 | A | A | 48 |
| 6 | 397 | 592 | 334 | 258 | 9.8 | A | A | 39 |
| 7 | 386 | 597 | 372 | 225 | 10.2 | A | A | 74 |
| 8 | 383 | 592 | 337 | 255 | 9.7 | A | A | 44 |
| 9 | 386 | 597 | 330 | 267 | 10.3 | A | A | 41 |
| 10 | 323 | 575 | 321 | 254 | 12.6 | A | A | 52 |
| 11 | 368 | 610 | 342 | 268 | 10.9 | A | A | 80 |
| 12 | 386 | 573 | 327 | 246 | 10.9 | A | A | 56 |
| 13 | 340 | 550 | 285 | 265 | 12.0 | B | A | 66 |
| 14 | 300 | 524 | 286 | 238 | 12.1 | B | A | 72 |
| 15 | 290 | 513 | 277 | 236 | 12.5 | B | A | 80 |

TABLE 3

| | Invention steel | | | | | | | |
|---|---|---|---|---|---|---|---|---|
| | Hardness (HV) | | | | | | | Maximum |
| Steel No. | Entire steel sheet | Martensite phase | Ferrite phase | Difference | Total elongation (%) | Yield elongation | Bending test result | hole expanding ratio (%) |
| 1 | 362 | 680 | 280 | 400 | 7.5 | B | B | 48 |
| 2 | 279 | 615 | 280 | 335 | 13.4 | B | B | 92 |
| 3 | 290 | 662 | 272 | 390 | 12.5 | B | B | 85 |
| 4 | 295 | 670 | 270 | 400 | 12.3 | B | B | 57 |
| 5 | 309 | 634 | 265 | 369 | 11.6 | B | B | 35 |
| 6 | 389 | 655 | 275 | 380 | 7.5 | B | B | 24 |
| 7 | 376 | 682 | 286 | 396 | 8.2 | B | B | 63 |
| 8 | 376 | 631 | 281 | 350 | 6.8 | B | B | 30 |
| 9 | 377 | 668 | 281 | 387 | 7.2 | B | B | 26 |
| 10 | 311 | 638 | 278 | 360 | 11.4 | B | B | 39 |
| 11 | 360 | 678 | 282 | 396 | 8.7 | B | B | 70 |
| 12 | 379 | 626 | 279 | 347 | 7.8 | B | B | 44 |

<Bending Test>

Figure 2:
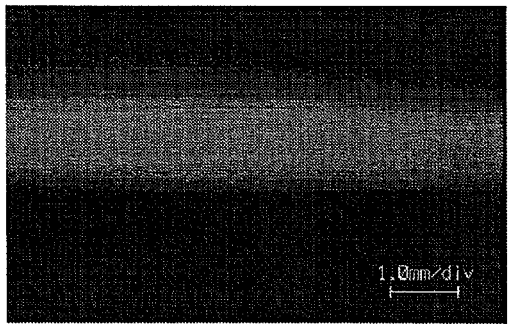
FIG. 2 includes photographs partially showing the appearance of stainless steel test pieces after bending test.
Figure 2:
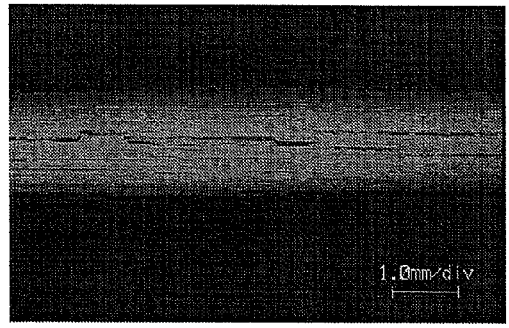

Each of the steel sheets thus obtained was cut into a rectangular shape 30 mm wide (a rolling direction)×60 mm long (a sheet width direction) to obtain a stainless steel test piece. A bending test was performed by pressing the stainless steel test piece against a 0.2R and 90° tip portion of a V-block jig to bend the piece by 90°. The bending test was performed so that the bend line would be parallel to the rolling direction. FIG. 2 includes pictures of the appearance of the test piece of the invention steel No. 1 and the test piece of the comparative steel No. 1 after the bending test. Generation of cracks was observed from the comparative steel, while generation of cracks was not observed from the invention steel. The results of the bending test are shown in Tables 2 and 3. The test piece from which generation of cracks is not observed is evaluated as "A", while that from which generation of cracks is observed is evaluated as "B".

<Hole Expanding Test>

Each of the steel sheets was cut into a rectangular shape 90 mm wide and 90 mm long to obtain a stainless steel test piece. After a hole having a diameter of 10 mm was punched into the test piece, a conical punch with a tip portion having an angle of 90° and a diameter of 40 mm was pushed into the punched hole of the test piece at a uniform speed. During pushing, the expanding state of the punched hole was observed carefully and as soon as cracks appeared at the edge of the hole, the pushing operation was terminated. The diameter of the punched hole at the time point when cracks appeared at the edge of the punched hole of the test piece was designated as the maximum expanded hole diameter and a maximum hole expanding ratio was determined in accordance with the following equation:

$$\text{Maximum hole expanding ratio (\%)}=((D-D_0)/D)\times 100$$

wherein, $D_0$ represents a diameter (mm) of a punched hole before pushing and D represents a maximum expanded hole diameter (mm). The results of the maximum hole expanding ratio are shown in Tables 2 and 3. The maximum hole expanding ratio of the invention steels tends to be about 5 to 15% greater than that of the comparative steels.

The above-described results have revealed that when a difference in hardness between the ferrite phase and the martensite phase is 300 HV or less, the stainless steel sheet showed good bending workability and hole expanding property. Based on the results of the hole expanding test in combination with the results of the tensile test, the invention steels are superior in ductility to the comparative steels, which suggests that the invention steels have excellent bending workability and hole expanding property.

<Analysis of Tempering Parameter>

Figure 3:
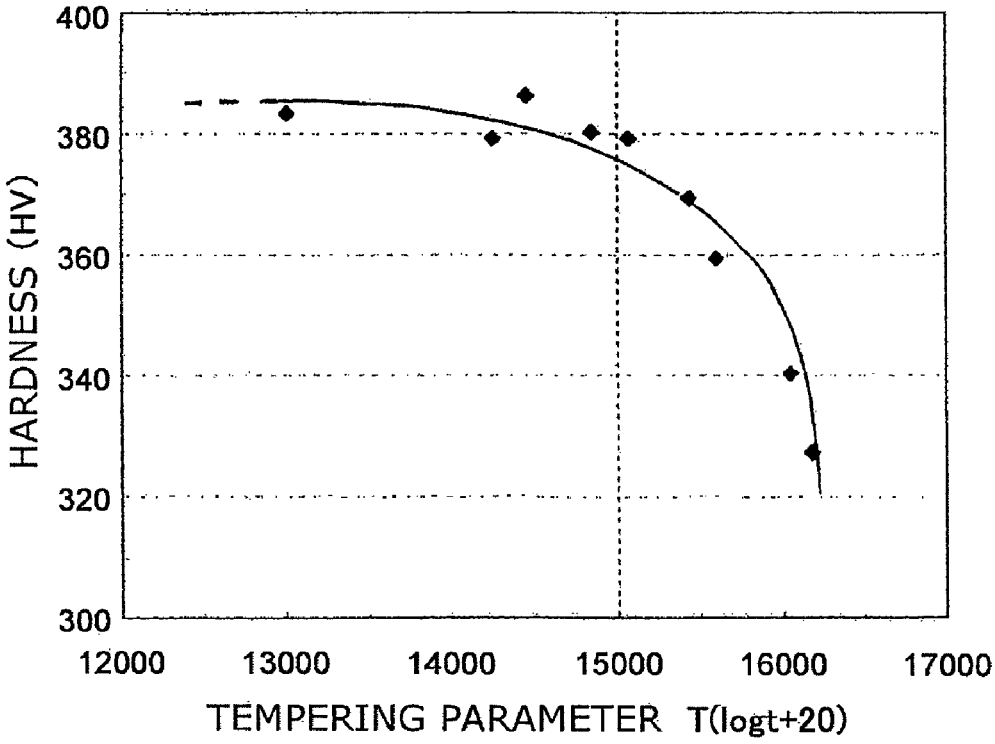
FIG. 3 is a plot diagram showing the relationship between a tempering parameter and hardness of a stainless steel test piece.

A steel piece, which had been obtained by subjecting the No. 1 steel to a similar dual-phase formation treatment to that employed above, was subjected to an aging treatment in the atmosphere under nine different conditions to give various tempering parameters, whereby respective stainless steel sheets were obtained. The tempering parameters are nine kinds, that is, 13000, 14240, 14440, 14830, 15060, 15420, 15580, 16040, and 16170. The entire stainless sheet was measured for Vicars hardness in the above-described manner. A graph obtained by plotting the relationship between tempering parameter and hardness is shown in FIG. 3. It has been found from the results that a marked reduction in hardness occurs when the tempering parameter exceeds 15000.

The present application is based on Japanese Patent Application (Japanese Patent Application No. 2008-27712) filed on Feb. 7, 2008, the content of which is incorporated herein by reference.

INDUSTRIAL APPLICABILITY

The present invention can provide a high-strength stainless steel material having less deterioration in mechanical strength and at the same time, having improved workability, particularly bending workability.

The invention claimed is:

1. A high-strength stainless steel material having a composition comprising, as essential components thereof, greater than 0.00 mass % but not greater than 0.15 mass % of C, greater than 0.0 mass % but not greater than 2.0 mass % of Si, greater than 0.0 mass % but not greater than 4.0 mass % of Mn, greater than 0.00 mass % but not greater than 0.04 mass % of P, greater than 0.00 mass % but not greater than 0.03 mass % of S, greater than 0.0 mass % but not greater than 4.0 mass % of Ni, from 10.0 to 20.0 mass % of Cr, and greater than 0.00 mass % but not greater than 0.12 mass % of N with a balance of Fe and inevitable impurities;

having a metal microstructure composed of two phases, one of the phases being a ferrite phase and the other of the phases being a martensite phase;

having a $\gamma_{max}$ of from 50 to 85, the $\gamma_{max}$ being represented by the following equation (1):

$$\gamma_{max}=420W_c+470W_N+23W_{Ni}+7W_{Mn}-11.5W_{Cr}-11.5W_{Si}+189 \quad (1)$$

(in the equation (1), $W_c$, $W_N$, $W_{Ni}$, $W_{Mn}$, $W_{Cr}$ and $W_{Si}$ represent contents (unit: mass %) of C, N, Ni, Mn, Cr, and Si relative to the total mass of the stainless steel material, respectively; and having a difference of 300 HV or less in hardness between the ferrite phase and the martensite phase and wherein the high-strength steel material has a hardness of 397 HV or less.

2. The high-strength stainless steel material according to claim 1, which has yield elongation.

3. The high-strength stainless steel material according to claim 1, further comprising greater than 0.0 mass % but not greater than 3.0% of Cu and having a $\gamma_{max}$ of from 50 to 85, the $\gamma_{max}$ being represented by the following equation (2):

$$\gamma_{max}=420W_c+470W_N+23W_{Ni}+9W_{Cu}+7W_{Mn}-11.5W_{Cr}-11.5W_{Si}+189 \quad (2)$$

(in the equation (2), $W_c$, $W_N$, $W_{Ni}$, $W_{Cu}$, $W_{Mn}$, $W_{Cr}$, and $W_s$; represent contents (unit: mass %) of C, N, Ni, Cu, Mn, Cr, and Si relative to the total mass of the stainless steel material, respectively.

4. A production process of a high-strength stainless steel material comprising a step of subjecting, to a dual-phase formation treatment, a steel piece having a composition comprising, as essential components, greater than 0.00 mass % but not greater than 0.15 mass % of C, greater than 0.0 mass % but not greater than 2.0 mass % of Si, greater than 0.0 mass % but not greater than 4.0 mass % of Mn, greater than 0.00 mass % but not greater than 0.04 mass % of P, greater than 0.00 mass % but not greater than 0.03 mass % of S, greater than 0.0 mass % but not greater than 4.0 mass % of Ni, from 10.0 to 20.0 mass % of Cr, and greater than 0.00 mass % but not greater than 0.12 mass % of N with a balance of Fe and inevitable impurities; and having a $\gamma_{max}$ of from 50 to 85, the $\gamma_{max}$ being represented by the following equation (1):

$$\gamma_{max}=420W_c+470W_N+23W_{Ni}+7W_{Mn}-11.5W_{Cr}-11.5W_{Si}+189 \quad (1)$$

(in the equation (1), $W_c$, $W_N$, $W_{Ni}$, $W_{Mn}$, $W_{Cr}$, and $W_{Si}$ represent contents (unit: mass %) of C, N, Ni, Mn, Cr, and Si relative to the total mass of the steel piece, respectively); and subjecting the steel piece obtained by the dual-phase formation treatment to an aging treatment, wherein the high-strength stainless steel material has a difference of 300 HV or less in hardness between a ferrite phase and a martensite phase and wherein the high-strength steel material has a hardness of 397 HV or less.

5. The production process of a high-strength stainless steel material according to claim 4, wherein the steel piece further contains greater than 0.0 mass % but not greater than 3.0 mass % of Cu and has $\gamma_{max}$ of from 50 to 85, the $\gamma_{max}$ being represented by the following equation (2):

$$\gamma_{max}=420W_c+470W_N+23W_{Ni}+9W_{Cu}+7W_{Mn}-11.5W_{Cr}-11.5W_{Si}+189 \quad (2)$$

(in the equation (2), $W_c$, $W_N$, $W_{Ni}$, $W_{Mn}$, $W_{Cr}$, and $W_{Si}$ represent contents (unit: mass %) of C, N, Ni, Cu, Mn, Cr, and Si relative to the total mass of the steel piece, respectively).

6. The production process of producing a high-strength stainless steel material according to claim 4, wherein a maximum temperature in the aging treatment step is less than 600° C.

7. The high-strength stainless steel material according to claim 2, further comprising greater than 0.0 mass % but not greater than 3.0% of Cu and having a $\gamma_{max}$ of from 50 to 85, the $\gamma_{max}$ being represented by the following equation (2):

$$\gamma_{max}=420W_c+470W_N+23W_{Ni}+9W_{Cu}+7W_{Mn}-11.5W_{Cr}-11.5W_{Si}+189 \quad (2)$$

(in the equation (2), $W_c$, $W_N$, $W_{Ni}$, $W_{Cu}$, $W_{Mn}$, $W_{Cr}$, and $W_{Si}$ represent contents (unit: mass %) of C, N, Ni, Cu, Mn, Cr, and Si relative to the total mass of the stainless steel material, respectively.

8. The production process of producing a high-strength stainless steel material according to claim 5, wherein a maximum temperature in the aging treatment step is less than 600° C.

* * * * *

UNITED STATES PATENT AND TRADEMARK OFFICE

CERTIFICATE OF CORRECTION

PATENT NO. : 8,273,191 B2
APPLICATION NO. : 12/811617
DATED : September 25, 2012
INVENTOR(S) : N. Hirakawa et al.

It is certified that error appears in the above-identified patent and that said Letters Patent is hereby corrected as shown below:

At column 14, line 67 (claim 1, line 22) of the printed patent, please insert --)-- after respectively.

At column 15, line 16 (claim 3, line 10) of the printed patent, please insert --)-- after respectively.

At column 16, line 30 (claim 7, line 10) of the printed patent, please insert --)-- after respectively.

Signed and Sealed this
Ninth Day of April, 2013

Teresa Stanek Rea

Teresa Stanek Rea
*Acting Director of the United States Patent and Trademark Office*